United States Patent [19]

Batzill

[11] 4,391,858

[45] Jul. 5, 1983

[54] COATING PROCESS

[75] Inventor: Wolfgang Batzill, Münster, Fed. Rep. of Germany

[73] Assignee: Glasurit America, Inc., Detroit, Mich.

[21] Appl. No.: 323,367

[22] Filed: Nov. 20, 1981

[51] Int. Cl.[3] ..... B05D 1/36

[52] U.S. Cl. ..... 427/407.1; 427/409

[58] Field of Search ..... 427/203, 205, 407.1, 427/409

[56] References Cited

U.S. PATENT DOCUMENTS

| | | | |
|---|---|---|---|
| 1,765,748 | 6/1930 | Teague | 427/203 |
| 3,136,651 | 6/1964 | Spessard | 427/203 |
| 3,666,521 | 5/1972 | Weyna et al. | 427/203 |
| 4,098,928 | 7/1978 | Noomen et al. | 427/203 |
| 4,268,542 | 5/1981 | Sakakibara et al. | 427/203 |
| 4,278,483 | 7/1981 | Mansolillo | 427/203 |

*Primary Examiner*—John D. Smith
*Assistant Examiner*—Janyce A. Bell
*Attorney, Agent, or Firm*—Wells & Wells

[57] ABSTRACT

A process for the production of a multilayer protective and/or decorative coating upon the surface of a substrate (1) A basecoat composition is applied comprising:

(A) a film-forming polymer;

(B) a volatile organic liquid diluent in which the polymer is dissolved;

(C) polymer microparticles which are insoluble in the solution of the polymer (A) in the liquid diluent (B) and are stably dispersed by steric stabilization therein in a non-flocculated state in an amount of from 3% to 8% of the aggregate weight of the film-forming polymer A and the microparticles;

(D) pigment particles also dispersed in the solution of the film-forming polymer in the liquid diluent.

(2) A polymer film is formed upon the surface from the composition applied in (1).

(3) A transparent topcoat is applied to the basecoat film from a composition comprising:

(E) a film-forming polymer; and (F) a volatile carrier liquid for the polymer.

(4) A second polymer film is formed upon the basecoat film from the composition applied in (1).

13 Claims, No Drawings

COATING PROCESS

This invention relates to the application of protective and decorative coatings to surfaces, particularly the surfaces of automobile bodies.

It is well known to employ, especially in the automobile industry, coating compositions which contain metallic pigments; these are the so-called "glamour metallic" finishes whereby a differential light reflection effect, depending on the viewing angle, is achieved. To maximize this flip-flop tone effect, careful formulation of the coating composition in regard both to the film-forming resin and to the liquid medium is required. Difficulties may be encountered in meeting this objective and at the same time achieving a good weatherability in the final finish such as is usually desired in the automobile field. For this reason, the preferred procedure for producing metallic finishes today is a two-coat procedure, in which there is first applied to the surface of the substrate a base coat containing the metallic pigment and formulated so as to give the optimum flip-flop effect, and there is then applied over the base-coat an unpigmented top coat which will yield the desired degree of weatherability without in any way modifying the characteristics of the base coat.

An essential criterion of a successful two coat metallic finish system is that there must be no tendency for the top coat, when applied, to mix with or even have any appreciable solvent action on, the previously applied base-coat. If this requirement is not fulfilled, the metallic pigmentation effect may be seriously impaired. In principle, this requirement could be met by using, in the base-coat and the top-coat respectively, film-forming materials which are mutually incompatible, but the necessary adhesion between the two coats would not then be obtained. A more practicable way of meeting the requirement is to arrange for the base-coat to be of the thermosetting type and to give that coat at least a short curing treatment before the top-coat is applied, but this introduces an undesirable complication into the production schedule by interrupting the spraying operation with a stoving operation. A more desirable state of affairs is that the base-coat should be capable of drying in a few minutes only, under normal spray-booth conditions, to an extent such that it is not disturbed by the application to it of the top-coat.

For two-coat automobile metallic finishes based on solutions of acrylic polymers in volatile organic solvents, one method which has been proposed in order to achieve the last-mentioned objective is to employ as the base-coat a pigmented solution of an acrylic polymer containing a cellulose ester, for example, cellulose acetate butyrate, and as the top-coat an unpigmented solution of a specified cross-linkable acrylic copolymer together with a cross-linking agent for the copolymer; the base-coat is applied to the substrate and the top-coat is subsequently applied without any intermediate baking of the base-coat, a final stoving operation being given to cure the top-coat.

There is, however, an associated disadvantage, namely that the addition of the cellulose ester to the base-coat composition raises the viscosity of the latter appreciably. Base-coat/clear-coat systems are overwhelmingly intended for spray application, and it is well recognized that the viscosity of the coating composition being sprayed is an important factor in the production of a satisfactory film upon the substrate.

Consequently, the use of the cellulose ester means in general that the content of the main film-forming polymer in the base-coat composition (which polymer, of course, makes its own substantial contribution to the viscosity of the composition as a whole) is subject to limitation. The base-coat composition must, in other words, contain a relatively higher proportion of volatile solvent and diluent.

The present invention is based upon the discovery that, instead of using a cellulose ester or other resin, the same benefits in a base-coat/clear-coat system can be achieved by incorporating in the base-coat composition *a specified type of polymer microparticle,* which is dispersed therein in a sterically stabilized non-flocculated state. The presence of the microparticles makes it possible to apply top-coat to base-coat after only a short interval, without the base-coat film being disturbed, and yet the microparticles have a much reduced effect upon the viscosity of the composition. Consequently, a base-coat composition of a given film-forming solids content formulated with the polymer microparticles has a significantly lower viscosity than one of the same solids content formulated with cellulose acetate butyrate; or, more importantly, at a given viscosity a composition containing microparticles can contain significantly more film-forming solids than one containing the cellulose ester. This second aspect is of special significance in the search for coating compositions having a reduced potential for atmospheric pollution.

According to the present invention there is provided a process for the production of a multilayer protective and/or decorative coating upon the surface of a substrate, which comprises the steps of:

(1) applying to the surface of base-coat composition comprising:

(A) a film-forming polymer;

(B) a volatile organic liquid diluent in which the polymer is dissolved;

(C) polymer microparticles as hereinafter defined which are insoluble in and are stably dispersed by steric stabilization in the solution of the film-forming polymer in the liquid diluent;

(D) pigment particles also dispersed in the solution of the film-forming polymer in the liquid diluent;

(2) forming a polymer film upon the surface from the composition applied in step (1);

(3) applying to the base-coat film so obtained a transparent top-coat composition comprising:

(E) a film-forming polymer;

(F) a volatile carrier liquid for the polymer;

(4) forming a second polymer film upon the base-coat film from the composition applied in step (3).

The film-forming polymer constituent (A) of the base-coat composition used in step (1) of the process may be any of the polymers known to be useful in coating compositions. One suitable class of polymer consists of those which are derived from one or more ethylenically unsaturated monomers. Particularly useful members of this class are the acrylic addition polymers which are well established for the production of coatings in the automobile industry, that is to say polymers or copolymers of one or more alkyl esters of acrylic acid or methacrylic acid, optionally together with one ethylenically unsaturated monomers. These polymers may be of either the thermoplastic type or the thermosetting, cross-linking type. Suitable acrylic esters for either type of polymer include methyl methacrylate, ethyl methacrylate, propyl methacrylate, butyl methacrylate, ethyl acrylate, butyl acrylate and 2-ethylexyl acrylate. Suitable other, copolymerizable monomers include vinyl acetate, vinyl propionate, acrylonitrile, acrylamide, N-(alkoxymethyl) acrylamides and N-(alkoxymethyl) methacrylamides, where the alkoxy group may be, for example, a butoxy group, styrene and vinyl toluene. Where the polymer is required to be of the cross-linking type, suitable functional monomers to be used in addition to the latter include acrylic acid, methacrylic acid, hydroxyethyl acrylate, hydroxyethyl methacrylate, 2-hydroxyproply acrylate, 2-hydroxypropyl methacrylate, glycidyl acrylate and glycidyl methacrylate. The base-coat composition may in such a case contain also a cross-linking agent such as a diisocyanate, a diepoxide or, especially, a nitrogen resin, that is to say a condensate of formaldehyde with a nitrogeneous compound such as urea, thiourea, melamine or benzoguanamine, or a lower alkyl ether of such a condensate in which the alkyl group contains from 1 to 4 carbon atoms. Particularly suitable cross-linking agents are melamineformaldehyde condensates in which a substantial proportion of the methylol groups have been etherified by reaction with butanol or methanol.

For the purposes of the foregoing general definition of the invention, the cross-linking agent, where present, is considered as being a part of the film-forming polymer (A).

The base-coat composition may incorporate a suitable catalyst for the cross-linking reaction between the film-forming polymer (A) and the cross-linking agent, for example an acid-reacting compound such as acid butyl maleate, acid butyl phosphate or p-toluene sulphonic acid. Alternatively the catalytic action may be supplied by the incorporation of free acid groups in the film-forming polymer, for example by the use of acrylic acid or methacrylic acid as comonomer in the preparation of an acrylic polymer.

The film-forming polymer may be prepared by solution polymerization of the monomer(s), in the presence of suitable catalysts or initiators such as organic peroxides or azo compounds, e.g., benzoyl peroxide or azobisisobutyronitrile. Conveniently the polymerization may be carried out in the same organic liquid that is to form the diluent constituent (B) of the base-coat composition, or in a liquid which is to form a part of that diluent. Alternatively the acrylic polymer may be prepared, e.g. by dispersion polymerization.

Other suitable members of the class of polymer derived from ethylenically unsaturated monomers are vinyl copolymers, that is to say copolymers of vinyl esters of inorganic or organic acids, for example vinyl chloride, vinyl acetate and vinyl propionate; the copolymers may optionally be partially hydrolyzed so as to introduce vinyl alcohol units.

Instead of being a polymer derived from ethylenically unsaturated monomers, the polymer constituent (A) of the base-coat composition may be an alkyd resin or a polyester.

Such polymers may be prepared in known manner by condensation of polyhydric alcohols and polycarboxylic acids, with or without the inclusion of natural drying oil fatty acids. Suitable polyhydric alcohols include ethylene glycol, propylene glycol, butylene glycol 1:6-hexylene glycol, neopentyl glycol, diethylene glycol, triethylene glycol, tetraethylene glycol, glycerol, trimethylopropane, trimethyolethane, pentaerythritol, dipentaerythritol, tripentaerythritol, hexanediol, oligomers of styrene and allyl alcohol (for example that sold by Montsanto Chemical Company under the designation RJ 100) and the condensation products of trimethylolpropane with ethylene oxide or propylene oxide (such as the products known commercially as "Niax" triols). Suitable polycarboxylic acids include succinic acid (or its anhydride), adipic acid, azelaic acid, sebacic acid, maleic acid (or its anhydride), fumaric acid, malonic acid, itaconic acid, phthalic acid (or its anhydride), isophthalic acid, terephthalic acid, trimellitic acid (or its anhydride) and pyromellitic acid (or its anhydride). Where it is desired to produce air-drying alkyd resins, suitable drying oil fatty acids which may be used include those derived from linseed oil, soya bean oil, tall oil, dehydrated castor oil, fish oils or tung oil. Normally it is preferred that the oil length of such an alkyd resin should not exceed 50%. All these polyester and alkyd resins contain a proportion of free hydroxyl and/or carboxyl groups which are available for reaction, if desired, with suitable cross-linking agents as discussed above.

The polymer constituent (A) of the base-coat composition may contain minor amounts of a cellulose ester, in particular cellulose acetate butyrate depending on the requirements concerning the allowed amount of solvent in the base-coat formulation.

Yet another type of polymer which may be employed as the constituent (A) comprises the nitrogen resins, which have already been described in the role of cross-linking agents for acrylic polymers of the thermosetting type. These same resins can be employed as film-forming materials in their own right and, for this purpose, the preferred resins are again melamine-formaldehyde condensates in which a substantial proportion of the methylol groups are etherified by reaction with butanol or methanol. In order to assist curing of the resin, there will preferably also be incorporated in the base-coat composition a suitable catalyst, such as one of those already described. From what has been said above, it will be clear that there may also be employed as the film-forming constituent (A) a mixture of a thermosetting acrylic polymer and a nitrogen resin in such proportions that part of the latter functions as cross-linking agent and part as a supplementary film-former in its own right.

The volatile organic liquid constituent (B) of the base-coat composition may be any of the liquids, or mixtures of liquids, which are conventionally used as polymer solvents in coating compositions, for example aliphatic hydrocarbons such as hexane and heptane, aromatic hydrocarbons such as toluene an xylene, and petroleum fractions of various boiling point ranges which are predominantly aliphatic but have a significant aromatic content, esters such as butyl acetate, ethylene glycol diacetate and 2-ethoxyethyl acetate, ketones such as acetone and methyl ethyl and methyl isobutyl ketone, and alcohols such as butyl alcohol. The actual liquid or mixture of liquids selected as the diluent (B) will depend upon the nature of the film-forming polymer (A), according to principles which are well known in the coatings art, in order that the polymer shall be soluble in the diluent.

The polymer microparticles (C) present in the base-coat composition are polymer particles of colloidal dimensions, having a diameter of from 0.01 to 10 microns, preferably from 0.03 to 3 microns. The polymer of which the microparticles are composed must be insoluble in the solution of the polymer (A) in the liquid diluent (B); this insolubility may be achieved by suitable selection of the composition of the microparticle polymer, that is to say, the polymer may be one which is inherently insoluble in the polymer solution, or it is achieved by introducing a sufficient degree of cross-linking into a polymer which, if not cross-linked, would actually be soluble in the solution of polymer (A) in dilent (B).

The microparticles are insoluble in common varnish solvents. Particles preferably used are those which do not coalesce during the application process and which can still be ascertained in the dried or stoved coating, e.g. by means of an electron microscope.

The microparticle polymer may be of various types. It may, for example, be an acrylic addition polymer, derived from one or more of the same monomers as have been described above in connection with the film-forming polymer constituent (A). Where it is desired that such a polymer should be cross-linked, this may be achieved by either of two general methods; firstly, by including in the monomers from which the polymer is derived a proportion of a monomer which is poly-functional with respect to the polymerization reaction, e.g. ethylene glycol dimethacrylate or divinylbenzene; or, secondly, by including in those monomers proportions of two other monomers carrying pairs of chemical groups which can be caused to react with one another either during or after the polymerization reaction, such as epoxy and carboxyl (as for example in glycidyl methacrylate and methacrylate acid), anhydride and hydroxyl or isocyanate and hydroxyl. Alternatively, the microparticles may be composed of a condensation polymer, for example a polyester prepared from any of the polyhydric alcohols and polycarboxylic acids described above. Again, such polymers may be cross-linked if desired, by the incorporation of materials of functionality greater than two in the starting composition.

The chemical composition and degree of cross-linking of the microparticle polymer may be such that it has a Tg (glass-rubber transition temperature) below room temperature, in which case the microparticles will be rubbery in nature; alternatively it may be such that Tg is above room temperature, that is to say the particles will be hard and glassy.

As already stated, it is necessary that the polymer microparticles be stably dispersed in the solution of the base-coat film-forming polymer in the liquid diluent. By "stably dispersed" is meant that the particles are prevented from flocculating or aggregating by means of a steric barrier around the particles of polymer chains which are solvated by the said solution and hence are in a chain-extended configuration. In this context the term "solvated" implies that the polymer chains in question, if they were independent molecules, would be actually soluble in the film-forming polymer solution; however, because the chains are in fact attached to the microparticles at one or more points along their length, the steric barrier remains permanently attached to the particles. It will be understood that the stabilizing polymer chains to be used in any particular instance will be selected with reference to the nature of the liquid diluent and film-forming polymer concerned. In general terms this means that the chains will be of a degree of polarity similar to that of the diluent and film-forming polymer, so that the combination of the latter will be inherently a solvent for the polymer of which the chains are composed. Since, in the two-coat automobile finishes to which the present invention is primarily directed, the liquid diluent will conventionally be of a relatively high degree of polarity (containing, for example, a substantial proportion of "strong" ester and ketone solvents) it follows that the stabilizing chains on the microparticles will usually require to be of a composition such that they are inherently soluble in that type of liquid.

The mode of anchoring of the stabilizing chains to the microparticles is conveniently discussed in connection with methods of making the particles, as follows.

The polymer microparticles may be produced in a variety of ways. Preferably they are produced by a process of dispersion polymerization of monomers, in an organic liquid in which the resulting polymer is insoluble, in the presence of a steric stabilizer for the particles. Suitable processes of dispersion polymerization are well-known and extensively described in the literature. Thus, so far as the dispersion polymerization of ethylenically unsaturated monomers such as acrylic or methacrylic acid esters, vinyl esters and styrene or its derivatives is concerned, the procedure is basically one of polymerizing the monomers in an inert liquid in which the monomers are soluble but the resulting polymer is not soluble, in the presence dissolved in the liquid of an amphipathic stabilizing agent or of a polymeric precursor which, by copolymerization or grafting with a portion of the monomers, can give rise in situ to such a stabilizing agent. Reference may be made, for example, to U.S. Pat. No. 3,365,414.

Suitable ethylenically unsaturated monomers include methyl methacrylate, ethyl methacrylate, butyl methacrylate, ethyl acrylate, butyl acrylate, 2-hydroxyethyl acrylate, vinyl acetate, vinyl propionate, styrene vinyl toluene, acrylonitrile acrylamide, N-(alkoxymethyl) acrylamides and N-(alkoxymethyl)methacrylamides, where the alkoxy group may be, for example, a butoxy group. The production specifically of dispersions of cross-linked addition polymer particles can be achieved by including, in the monomers selected, pairs of monomers containing (in addition to the polymerizable unsaturated groups) groups capable of entering into chemical reaction with each other; for example, the epoxide and carboxyl groups contained in glycidyl methacrylate and methacrylic acid.

Cross-linked addition polymers may also be prepared in dispersion by including in the monomers undergoing dispersion polymerization a proportion of a monomer which is difunctional with respect to the polymerization reaction, such as ethyleneglycol dimethacrylate or divinylbenzene.

Proportions of comonomers incorporating carboxyl groups, e.g. acrylic acid or methacrylic acid, may be included (where the microparticles are to be cross-linked, such proportions would be in excess of those used in order to achieve cross-linking by reaction with a co-reactive monomer such as glycidyl methacrylate). Conversely, (additional) proportions of an epoxide monomer, e.g. glycidyl methacrylate, may be included. Other functional monomers, such as hydroxyethyl acrylate may also be included in the monomers from which the microparticles are to be derived.

In case of a preferred embodiment of dispersion polymerization the microparticles are only partly insoluble or cross-linked. In this case the soluble art of the dispersion is the film-forming polymer (A). The amount of soluble particles is controlled by the amount of polar monomers, e.g. acrylnitrile or acrylamide in the dispersed polymer.

The production of dispersions of condensation polymers is described, for example, in British Pat. Nos. 1,373,531; 1,403,794 and 1,419,199, and methods of obtaining cross-linked polymer particles are included in these descriptions. The general principles involved here are the same as those referred to above in connection with addition polymer dispersions, but there is a difference of detail arising from the commonly more highly polar nature of the monomers or starting materials from which condensation polymers are derived. This is, namely, that the monomers in question are usually insoluble in the inert liquid in which the polymerization is to be carried out. Accordingly the first step in the dispersion polymerization of the monomers is to bring them into a state of colloidal dispersion in the inert liquid, either as liquid or as solid particles. In the second step, polymerization of the monomers takes place within those same particles. An amphipathic stabilizing agent is required in each stage, firstly in order to stabilize the particles of monomer and secondly in order to stabilize the particles of polymer formed, but in suitable cases a single stabilizing agent can be found which will perform both these functions. In place of using a pre-formed amphipathic stabilizing agent in this process, there may be employed instead a suitable polymeric precursor which, by copolymerization or grafting with a portion of the monomers being polymerized, can give rise to such a stabilizing agent in situ. Reference may be made in this connection to British patent application Ser. No. 19487/76.

Suitable monomeric starting materials for preparing condensation polymer microparticles are those which are well-known for use in making such polymers by melt or solution polymerization techniques. For example, suitable materials in the case of polyester microparticles are the polyhydric alcohols and polycarboxylic acids mentioned above in connection with the film-forming polymer (A). In the case of polyamide microparticles, suitable monomeric starting materials are amino acids, such as 6-aminocaproic acid or 11-aminoundecanoic acid, or the corresponding lactams, and/or polyamines, such as ethylene diamine, propylene diamine, hexamethylene diamine, diethylene triamine, triethylene tetramine or tris(aminomethyl) methane, in conjunction with the polycarboxylic acids mentioned above. It will, of course, be understood that, in the case of both polyester and polyamide microparticles, the mixture to be polymerized must incorporate some proportion of a starting monomer which has a functionality greater than two, where it is desired that the microparticles should be cross-linked.

In all the above-described dispersion polymerization processes, the amphipathic stabilizing agent is a substance the molecule of which contains a polymeric component which is solvatable by the liquid in which the dispersion is made and another component which is relatively non-solvatable by that liquid and is capable of associating with the polymer particles produced. Such a stabilizing agent will be soluble as a whole in the dispersion liquid, but the resulting solution will usually contain both individual molecules and micellar aggregates of molecules, in equilibrium with each other. The type of stabilizing agent preferred for use in the invention is a block or graft copolymer containing two types of polymeric component; one type consists, as stated above, of polymer chains which are solvatable by the dispersion liquid and the other type consists of polymer chains of different polarity from the first type which accordingly are not solvatable by that liquid and are capable of becoming anchored to the polymer microparticles. A particularly useful form of such a stabilizing agent is a graft copolymer comprising a polymer backbone, which is the solvatable component, and a plurality of non-solvatable polymer chains pendant from the backbone. Specific examples of such graft copolymers include those in which the backbone is a butylated melamineformaldehyde polyene chain readily solvatable by an aliphatic hydrocarbon medium, and the pendant chains are acrylic polymer chains the monomer sequence of which is similar to that of the film-forming polymer (A) provided this is an acrylic polymer.

It may be necessary to subject the particles obtained by dispersion polymerization to a further treatment in order to render them suitable for use in the process of the invention. This need may arise in the following way. The most convenient inert liquids in which to carry out dispersion polymerizations are liquids of low polarity, for example aliphatic or aromatic hydrocarbons or mixtures thereof; this is because such liquids are non-solvents for the majority of polymers, whether of the addition or of the condensation type, and therefore, give scope for the widest choice of polymer or copolymer compositions according to the properties which it is desired the microparticles should possess. From the foregoing discussion it will, however, be appreciated that steric stabilizing agents which are suitable for stabilizing the microparticles in a simple low polarity liquid environment may no longer effectively stabilize them when they are transferred to the environment of the solution of the film-forming polymer (A) in the liquid diluent (B). One relevant factor is that (B) is likely to be a relatively highly polar liquid, where the formulation of automobile finishes is concerned, and another, perhaps more important, factor is that the polymer molecules (A) will now be competing with the chains of the stabilizing agent for the solvating action of the diluent. The consequence is that transfer of the microparticles to the new environment will result in their destabilization and flocculation.

It is, therefore, a preferred feature of the invention that microparticles which have been made by a dispersion polymerisation process are further associated with a polymer which is soluble in the volatile organic liquid constituent (B) of the base-coat composition and is also compatible with the film-forming polymer constituent (A). This further polymer, hereinafter referred to as the "auxiliary" polymer, is essentially non-cross-linked. It is believed that, when microparticles with which it is associated are introduced into the more highly polar environment of the solution of film-forming polymer (A) in the organic liquid (B), the chains of the auxiliary polymer now become solvated and take over at least in part from the original amphipathic stabilizer the function of maintaining the microparticles in a deflocculated, dispersed state. The scope of the present invention is now, however, in any way limited by the extent to which this belief is correct. The microparticles are most conveniently brought into association with the auxiliary polymer by following up the dispersion polymerization process immediately with the polymerisation of further monomer, from which the auxiliary polymer is to be derived, in the original inert liquid medium and in the presence of the original stabilizing agent.

In general, the auxiliary polymer will be required to have a composition such that it is compatible with the film-forming polymer (A), including any cross-linking agent for the polymer, indeed it may be identical with that polymer and, in certain circumstances as described below, even wholly replace it. The monomer or monomers from which the auxiliary polymer is to be derived will be chosen with this requirement in mind, as will be apparent to those skilled in the art.

On introducing the microparticles so treated into the solution of the polymer (A) in the liquid (B), part of the auxiliary polymer may be dissolved away by that more polar medium, but it is believed that a substantial portion of the auxiliary polymer chains remain attached to the microparticles (albeit now solvated by the medium), for example by virtue of their having become entangled with the chains of the microparticle polymer during their formation, or as a result of actual grafting onto those chains. If desired, the stability of the treated microparticles in the more polar medium may be enhanced by ensuring that covalent linkages are developed between the chains of the auxiliary polymer and those of the microparticles. This may be done, for example, by including an unsaturated carboxylic acid in the monomers from which the auxiliary polymer is derived. The carboxyl groups so introduced are able to react with epoxide groups, present in the microparticle polymer as the result of the use of a slight excess of the latter groups for the purpose of cross-linking that polymer by reaction with carboxyl groups in the manner described above.

The incorporation of the microparticles, made by dispersion polymerization, into the base-coat composition may be accomplished in various ways. In the case where the microparticles have been treated with an auxiliary polymer, it may be sufficient simply to add strong solvents to the dispersion of those treated microparticles, relying upon sufficient of the auxiliary polymer being dissolved away from the treated microparticles in order itself to provide the whole of the film-forming polymer constituent (A), whilst still leaving enough of that polymer attached to the microparticles to ensure their stabilization. Alternatively, a dispersion of the microparticles (whether treated with auxiliary polymer or not) may be blended with a solution of a pre-formed film-forming polymer (A) in a suitable diluent (B). Yet another possibility is to separate the microparticles from the dispersion in which they are made, for example by centrifuging, filtration or spray-drying, and to blend the microparticles with a solution of a polymer (A) in a diluent (B) as before.

It will be understood from the foregoing description that, for the purposes of the definition of the invention hereinbefore given, the film-forming constituent (A) is considered to comprise that portion of the auxiliary polymer, if such polymer is employed, which is dissolved away from the microparticles when the latter are incorporated into the base-coat composition.

The polymer microparticles (C) used in the process of the invention are present in an amount of 3 to 50% of the aggregate weight of the film-forming polymer (A) and the microparticles; preferably the amount is from 3 to 8% of that aggregate weight because of a better smoothness of the obtained multilayer coating.

The pigment particles (D) included in the base-coat composition may range in size from 1 to 50 microns and may be of any of the pigments conventionally used in surface coating compositions, including inorganic pigments such as titanium dioxide, iron oxide, chromium oxide, lead chromate and carbon black, and organic pigments such as phthalocyanine blue and phthalocyanine green, carbazole violet, anthrapyrimidine yellow, flavanthrone yellow, isoindoline yellow, indanthrone blue, quinacridone violet and perylene reds. For the present purposes, the term "pigment" is here meant to embrace also conventional fillers and extenders, such as talc or kaolin.

The process of the invention is, however, of particular value in the case of base-coat compositions containing metallic flake pigmentation which are intended for the production of "glamour metallic" finishes chiefly upon the surfaces of automobile bodies as previously discussed. The presence of the polymer microparticles (C) in base-coats containing metallic pigmentation gives a valuable degree of improvement in metal control during the application of the base-coat and the subsequent application of the transparent top-coat. Suitable metallic pigments include in particular aluminum flake and copper bronze flake. In general, pigments of any kind may be incorporated in the base-coat composition in an amount of from 2% to 100% of the aggregate weight of the film-forming polymer (A) and the microparticles (C). Where metallic pigmentation is employed, this is preferably in an amount of from 5% to 20% by weight of the aforesaid aggregate weight.

Such pigments, whether metallic or otherwise, may be incorporated into the base-coat compositions with the aid of known dispersants. Thus, in the case where the main film-forming polymer is of the acrylic type, an acrylic polymer of similar composition may be employed as pigment dispersant. Any such polymeric dispersant is also considered to be part of the film-forming constituent (A).

If desired, the base-coat composition may additionally incorporate other known additives, for example viscosity modifiers such as bentone or cellulose acetate butyrate.

The film-forming polymer constituent (E) of the top-coat composition employed in step (3) of the process of the invention may be in general any of the polymers described above for use in the basecoat composition. Like the latter, it may be of either the thermosetting or the thermoplastic type. The acrylic polymers, particularly the thermosetting type, are especially suitable. The polymer (E) need not, however, be identical with the base-coat polymer (A). In one important respect, it may be clearly distinguished from the base-coat polymer: namely that, whereas the base-coat polymer is always employed in a state of solution in the organic liquid constituent of the base-coat composition, the top-coat polymer may be either in solution or in stable dispersion in the volatile carrier liquid (2) of the top-coat composition.

Thus, the carrier liquid (F) may be either a solvent or a non-solvent for the top-coat polymer. Where the liquid is to be solvent, it may be any of the volatile organic liquids or mixtures thereof previously mentioned as suitable for use in the basecoat composition. Where the liquid is to be a nonsolvent, it will tend to be of rather lower polarity than the former and may consist of one or more aliphatic hydrocarbons such as hexane, heptane or petroleum fractions of low aromatic content, optionally in admixture with liquids of high polarity as already referred to provided that the total mixture is a non-solvent for the top-coat polymer.

Where the top-coat composition is a polymer dispersion, this will in general be a sterically stabilized dispersion in which the polymer particles are stabilized by means of a block or graft copolymer, one polymeric constituent of which is non-solvatable by that liquid and is associated with the disperse polymer. The well-known principles according to which such dispersions may be prepared have been referred to above in connection with the making of the microparticles of the base-coat composition.

In the case where the top-coat polymer is of the thermosetting or cross-linking type, there may be incorporated in the top-coat composition a cross-linking agent, such as any of those which have been discussed above in connection with the base-coat composition. If the top-coat polymer is of the acrylic type, the proportion of cross-linking agent to polymer in the composition may vary widely, but in general a ratio of from 50:50 to 90:10 by weight of polymer to cross-linking agent is satisfactory. The precise proportion to be employed depends upon the properties required in the final film, but a preferred range affording a good balance of properties is from 60:40 to 85:15 by weight of polymer to cross-linking agent. Where it is of particular importance that the top-coat film should exhibit good resistance towards acid corrosion induced by severe atmospheric pollution, an especially preferred range of ratios of polymer to cross-linking agent is from 70:30 to 85:15 by weight.

As discussed in detail in connection with the base-coat composition, the top-coat composition may incorporate a suitable catalyst for the cross-linking reaction, or alternatively the top-coat polymer may be arranged to contain free acid groups.

The top-coat composition may in some cases contain both polymer in solution and polymer in dispersion. The soluble polymer may be a preformed polymer of different monomer composition from the dispersed polymer which, unlike the latter, is soluble in the carrier liquid (F) and is added as a solution therein to the dispersion. It may alternatively arise during the formation of the disperse polymer as the result of preferential polymerization of certain of the monomers present. Again, it may be polymer which is originally formed in dispersion but which, unlike the main film-former, passes into solution when there are added to the continuous phase liquid of the dispersion other liquids of stronger solvency than the latter in the course of formulating a paint with the required application characteristics.

Usually, the top-coat composition will be substantially colorless so that the pigmentation effect due to the base-coat is not significantly modified, but it may be desirable in some cases to provide a transparent tinting of the top-coat composition.

In the first operational step of the process of the invention, the base-coat composition is applied to the surface of the substrate, which may be previously primed or otherwise treated as conventional in the art. The substrates which are of principal interest in the context of the invention are metals such as steel or aluminum which are commonly used for the fabrication of automobile bodies, but other materials such as glass, ceramics, wood and even plastics can be used provided they are capable of withstanding the temperatures at which final curing of the multilayer coating may be effected. After application of the base-coat composition, a polymer film is formed therefrom upon the surface of the substrate. If desired, this may be achieved by subjecting the substrate and the applied coating to heat in order to volatilize the organic liquid diluent, and it lies within the scope of the invention to employ a heating temperature sufficient to cross-link the base-coat film in those cases where the polymer in question is of the thermosetting type. However, a particular merit of the present invention is that it is sufficient to allow only a short period of drying at or about room temperature in order to ensure that the top-coat composition can be applied to the base-coat film without there being any tendency for the former to mix with or dissolve the latter in a way which can interfere with the correct orientation of the metallic pigmentation, whereby optimum flip-flop effect is achieved. Typically, a drying time of from 1 to 5 minutes at a temperature of from 15° to 30° C. ensures that mixing of the two coats is prevented. At the same time, the base-coat film is adequately wetted by the top-coat composition, so that satisfactory intercoat adhesion is obtained.

After application of the top-coat composition to the base-coat film, the coated substrate is subjected to a curing operation in which the top-coat, and, optionally the base-coat also, is cross-linked with the aid of the cross-linking agent(s) present. This curing operation is carried out at an elevated temperature as is conventional in the thermosetting coating composition art, usually at a temperature in the range 100°–140° C., but, if desired, at a lower temperature provided the cross-linking system is sufficiently reactive.

In performing the process of the invention, the base-coat and top-coat compositions may be applied to the substrate by any of the conventional techniques such as brushing, spraying, dipping or flowing, but is preferred that spray application be used since the best results are thereby achieved in regard to both pigment control, especially of metallic pigment orientation, and gloss. Any of the known spray procedures may be adopted, such as compressed air spraying, electrostatic spraying, hot spraying and airless spraying, and either manual or automatic methods are suitable.

The thickness of the base-coat film applied is preferably from 0.5 to 1.5 mils and that of the top-coat from 1 to 3 mils (dry film thickness in each case).

The invention is illustrated but not limited by the following Examples, in which parts and percentages are by weight unless otherwise indicated.

EXAMPLE 1

A. Stabilizer precursor 18.3 parts melamine, 16.5 parts n-butanol, 60.0 parts butyl formaldehyde solution (containing 40 weight percent formaldehyde, 51 weight percent n-butanol and 9 weight percent water), 5.1 parts Soltrol 50 (Phillips Petroleum) and 0.03 parts phthalic anhydride are mixed in a reactor equipped with a distillation receiver, water condenser, thermometer and stirrer. The mixture is heated to reflux for a period of about six hours during which all water is removed. Excess n-butanol is then removed by vacuum distillation to produce a solution having a final viscosity of U (Gardner-Holdt) at 62.5 percent solids.

B. Nonaqueous dispersion with insoluble microparticles

A reaction flask equipped with a water condenser, thermometer and stirrer is charged with 281 parts of the above melamine resin, 243 parts of an aliphatic hydrocarbon mixture having a distillation range of 210°–275° F. and 0.8 parts of azobisisobutyronitrile. The reaction mixture is heated to 80° C. with agitation under a nitrogen atmosphere and an acrylic monomer solution consisting of 65 parts methyl-methacrylate, 52 parts acrylonitrile, 70 parts styrene, 40 parts butylmethacrylate, 36 parts butylacrylate, 64 parts hydroxypropylmethacrylate, 5 parts acrylic acid, 139 parts of the same aliphatic hydrocarbon mixture as above and 4.4 parts azobisisobutyronitrile is added dropwise over a period of 3 hours at a constant temperature of 80° C. with stirring. After addition is complete the reaction mixture is agitated for 1 hour at the same temperature. 0.6 parts azobisisobutyronitrile is added and heating and stirring are continued for another 2 hours. The product is a milky-white polymer dispersion with a solid content of 51%.

C. Acrylic resin solution for top-coat

A reaction flask equipped with a water condenser, thermometer, stirrer and dropping funnel is charged with 447 parts solventnaphtha. The solventnaphtha is heated with agitation under an atmosphere of nitrogen to 140' C. An acrylic monomer mixture consisting of 350 parts styrene, 70 parts methyl methacrylate, 463 parts butyl methacrylate, 280 parts 2-ethylhexyl acrylate, 210 parts hydroxypropylmethacrylate, 28 parts acrylic acid and 28 parts t-butylperbenzoate is added continuously over a 3 hour period maintaining the temperature at 140° C. After the above addition is complete the temperature and stirring are maintained for another 3 hours. Thereafter 323 parts xylene are added. The final resin solution has a solid content of 60%.

D. Production of a base-coat and application thereof 62.5 parts of dispersion from Example 1B; 27.8 parts CAB-solution (3% acetyl groups and 50% butyril groups), (Eastman Kodak CAB 531.1); 15% solution in butyl acetate; 19.2 parts of aluminum flakes (32% in xylene); 0.1 part of soya lecithin are mixed. This mixture is adjusted with xylene/butyl acetate 1:1 to a viscosity of 28" in Din 4 cups and after application the obtained base-coat results in a primer having a favorable metallic effect (Din=German Industrial Standard).

E. Production of a clear-coat and application thereof 47.5 parts solution acrylic 1C; 10 parts butyl glycol acetate; 2 parts xylene; 34.5 parts melamine formaldehyde resin (60% solution); 1 part of a 5% silicone oil solution are carefully mixed and by means of a solvent mixture (xylene/butylacetate 1:1) adjusted to a viscosity in a DIN 4 cup of 28". After a 5 minute flash-off period of the base-coat (1D) the resulting clear-coat is applied as top-coat to the respective base-coat. After a final flash-off time of 10 minutes the object coated in above-mentioned way is stoved 30' at 130° C.

EXAMPLE 2

A. Stabilizer precursor 15 parts melamine, 3 parts n-butanol, 54 parts butyl formaldehyde solution (containing 40 weight percent formaldehyde, 51 weight percent n-butanol and 9 percent water) and 0.03 parts phthalic anhydride are mixed in a reactor equipped with a distillation receiver, water condenser, thermometer and stirrer. The mixture is heated to reflux for 5 minutes. Thereafter 23 parts lauryl alcohol and 5 parts xylene were added, and the reaction mixture was heated to remove water for 8 hours. The Gardner-Holdt viscosity was then Z at 70% solid contents.

B. Nonaqueous dispersion-with insoluble microparticles

A reaction flask equipped with a water condenser, thermometer, stirrer and dropping funnel is charged with 176 parts of the above melamine resin, 343 parts of an aliphatic hydrocarbon mixture having a distillation range of 210°-275° F. and 1.3 parts of azobisisobutyronitrile. The reaction mixture is heated with agitation under a nitrogen atmosphere to 80° C. and an acrylic monomer solution consisting of 200 parts ethyl acrylate, 36 parts acrylonitrile, 79 parts styrene, 66 parts hydroxypropylmethacrylate, 7 parts acrylic acid and 5.2 parts azobisisobutyronitrile is added continuously over a 3 hour period. A temperature of 80° C. is maintained throughout the above addition period. The temperature is maintained for another 3 hour period after the above addition is complete. The reaction product is a milky white dispersion with a solid content of 50%.

C. Preparation and application of a base-coat 57.2 parts dispersion 2B, 32.2 parts CAB solution (as described in Example 1C), 27.0 parts aluminum flakes (32% in xylene), 9.7 parts soya lecithin, are thoroughly mixed. The resulting mixture is thinned and applied as in Example 1D. The appearance of the finished object is comparable to the object described in Example 1D.

D. Preparation and application of a base-coat 80.2 parts dispersion 2B, 3.4 parts copolymer solution from Example 1C, 24.6 parts aluminum flakes (32% in xylene), 9.7 parts soya lecithin, are thoroughly mixed and after adjusting to a viscosity over 28" in an Din 4 cup sprayed onto a metal sheet.

The appearance of the coating is similar to that of Example 1D.

EXAMPLE 2E, F

The clear-coat from Example 1E is applied over the base-coats 2C and 2D.

EXAMPLE 3

A. Nonaqueous dispersion

A reaction flask equipped with a water condenser, thermometer, stirrer and dropping funnel is charged with 336 parts of the melamine resin of Example 1, 449 parts Soltrol 50 (Phillips Petroleum), 4 parts methylmethacrylate, 12 parts hydroxypropylacrylate, 16 parts 2-ethylhexylacrylate, 25 butylmethacrylate, 19 parts styrene, 2 parts acrylic acid, 20 parts acrylamide and 4 parts azobisisobutyronitrile. The reaction mixture is heated with agitation under a nitrogen atmosphere to 80° C. This temperature is held for 30 minutes. Thereafter a monomer mixture of 16 parts methylmethacrylate, 48 parts hydroxypropylmethacrylate, 78 parts styrene, 7 parts acrylic acid and 16 parts azobisisobutyronitrile was added continuously over a 3 hour period. A temperature of 80° C. was maintained throughout the above addition period. 6 parts of azobisisobutyronitrile is added and stirring at 80° C. is continued for another 3 hours. The reaction product is a milky-white polymer dispersion with a solid content of 54%.

B. Acrylic resin solution

A reaction flask equipped with a water condenser, thermometer, stirrer and dropping funnel is charged with 247 parts xylene. The xylene is heated to reflux with agitation under a nitrogen atmosphere and an acrylic monomer solution consisting of 230 parts styrene, 300 parts butylmethacrylate, 200 parts 2-ethylhexylacrylate, 50 parts methylmethacrylate, 200 parts hydroxypropylmethacrylate, 20 parts acrylic acid and 40 parts tert.-butylperbenzoate is added continuously over a 6 hour period maintaining the temperature at reflux. Reflux is maintained for another 2 hour period after the above addition is complete. Thereafter 420 parts xylene are added. The final resin solution has a solid content of 60%.

C. Preparation and application of a base-coat 73.8 parts dispersion from Example 3A, 11.7 parts copolymer solution from Example 3B, 28.8 parts aluminum flakes (32% in xylene), 0.1 parts soya lecithin, are mixed and after adjusting to spraying viscosity applied on a metal sheet and thereafter covered with the clear-coat from Example 1C.

We claim:

1. A process for the production of a multilayer protective and/or decorative coating upon the surface of a substrate, which comprises the steps of:

(1) applying to the surface a basecoat composition comprising:
  (A) a film-forming polymer;
  (B) a volatile organic liquid diluent in which the polymer is dissolved;
  (C) polymer microparticles of diameter 0.01 to 10 microns which are insoluble in the solution of the polymer (A) in the liquid diluent (B) and are stably dispersed by steric stabilization therein in a nonflocculated state in an amount of from 3% to 8% of the aggregate weight of said film-forming polymer of (A) and said microparticles;
  (D) pigment particles also dispersed in the solution of the film-forming polymer in the liquid diluent;
(2) forming a polymer film upon the surface from the composition applied in step (1);
(3) applying to the basecoat film so obtained a transparent topcoat composition comprising:
  (E) a film-forming polymer; and
  (F) a volatile carrier liquid for the polymer; and
(4) forming a second polymer film upon the basecoat film from the composition applied in step (1).

2. A process as claimed in claim 1, wherein the film-forming polymer constituent (A) is a polymer or copolymer of one or more alkyl esters of acrylic acid or methacrylic acid.

3. A process as claimed in claim 1, wherein the film-forming polymer constituent (A) is an alkyd resin or a polyester.

4. A process as claimed in claim 1, wherein the polymer microparticles (C) consist of a polymer or copolymer of one or more alkyl esters of acrylic acid or methacrylic acid.

5. A process as claimed in claim 1, wherein the polymer microparticles have been produced by a process of dispersion polymerization of monomers, in an organic liquid in which the resulting polymer is insoluble, in the presence of a steric stabilizer for the particles.

6. A process as claimed in claim 5, wherein the steric stabilizer is a graft copolymer of which one type of polymeric component is a polymer backbone which is solvatable by the organic liquid and of which another type of polymeric component consists of a plurality of polymer chains, pendant from the backbone, which are not solvatable by the organic liquid and which are capable of associating with the microparticles.

7. A process as claimed in claim 5, wherein the microparticles are brought into association with the auxiliary polymer by following up the dispersion polymerization process, whereby the microparticles are obtained, immediately with the polymerization of further monomer, from which the auxiliary polymer is to be derived, in the original inert liquid medium and in the presence of the original stabilizing agent.

8. A process as claimed in claim 1, wherein the microparticles are further associated with a polymer, hereinafter referred to as auxiliary polymer, which is soluble in the volatile organic liquid constituent (B) of the basecoat composition and is also compatible with the film-forming polymer constituent (A).

9. A process as claimed in claim 1, wherein said pigment particles (D) have a size from 1 to 50 microns.

10. A process as claimed in claim 9, wherein said polymer microparticles have a diameter of 0.03 to 3 microns.

11. A process as claimed in claim 9, wherein said pigment particles are non-metallic.

12. A process as claimed in claim 1, wherein the pigment particles (D) in the base-coat composition consist of a metallic flake pigment.

13. A process as claimed in claim 1, wherein the film-forming polymer (E) of the top-coat composition is a thermosetting acrylic polymer.

* * * * *